US010906309B2

(12) United States Patent
Hayashi

(10) Patent No.: US 10,906,309 B2
(45) Date of Patent: Feb. 2, 2021

(54) LIQUID DISCHARGE HEAD

(71) Applicant: Brother Kogyo Kabushiki Kaisha, Nagoya (JP)

(72) Inventor: Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/682,040

(22) Filed: Nov. 13, 2019

(65) Prior Publication Data

US 2020/0230956 A1 Jul. 23, 2020

(30) Foreign Application Priority Data

Jan. 23, 2019 (JP) ..... 2019-009154

(51) Int. Cl.
*B41J 2/14* (2006.01)

(52) U.S. Cl.
CPC ..... *B41J 2/14209* (2013.01); *B41J 2/14032* (2013.01); *B41J 2002/14483* (2013.01)

(58) Field of Classification Search
CPC ..... B41J 2/14032; B41J 2002/14483; B41J 2002/14419; B41J 2202/12; B41J 2/14201; B41J 2/14209; B41J 2/14233; B41J 2/14274; B41J 2/14282; B41J 2/1429; B41J 2/14298; B41J 2002/14217; B41J 2002/14225; B41J 2002/14241; B41J 2002/1425; B41J 2002/14266; B41J 2002/14306
See application file for complete search history.

(56) References Cited

U.S. PATENT DOCUMENTS 8,899,724 B2 12/2014 Akahane et al.
2011/0292130 A1* 12/2011 Hayashi ..... B41J 2/155 347/54
2012/0176450 A1 7/2012 Akahane et al.
2013/0082117 A1* 4/2013 Ito ..... B41J 2/14233 239/66
2017/0217173 A1* 8/2017 Naganuma ..... B41J 2/14201

FOREIGN PATENT DOCUMENTS

JP 2012-143948 A 8/2012

* cited by examiner

*Primary Examiner* — Kristal Feggins
(74) *Attorney, Agent, or Firm* — Banner & Witcoff, Ltd.

(57) ABSTRACT

A liquid discharge head includes a stacked body formed by plates stacked in a first direction, and having a liquid channel. The liquid channel includes: individual channels which include nozzles and pressure chambers communicating with the nozzles, respectively, and which are aligned in a second direction orthogonal to the first direction; a first common channel extending in the second direction and communicating with the individual channels; a second common channel extending in the second direction and communicating with the individual channels; first throttles each connecting one of the individual channels and the first common channel; and second throttles each connecting one of the individual channels and the second common channel. The plates include: a nozzle plate having the nozzles; a pressure chamber plate having the pressure chambers; a first common channel plate having the first common channel; and a second common channel plate having the second common channel.

16 Claims, 8 Drawing Sheets

LIQUID DISCHARGE HEAD

CROSS REFERENCE TO RELATED APPLICATION

The present application claims priority from Japanese Patent Application No. 2019-009154 filed on Jan. 23, 2019, the disclosure of which is incorporated herein by reference in its entirety.

BACKGROUND

Field of the Invention

The present disclosure relates to a liquid discharge head which discharges a liquid from a nozzle.

Description of the Related Art

As a liquid discharge head which discharges a liquid from a nozzle, there is a known ink-jet recording head which discharges an ink from nozzles. In this known ink-jet recording head, a plurality of individual channels are aligned in a horizontal one direction. Each of the plurality of individual channels includes, for example, a nozzle, a pressure generating chamber, a communicating channel connecting the nozzle and the pressure generating chamber, etc. Further, this ink-jet recording head is provided with a manifold extending in the one direction and a circulating channel extending in the one direction which are common to the plurality of individual channels. Each of the individual channels is further provided with a supply channel connecting the pressure generating chamber and the manifold and a circulation-communication path connecting the communicating channel and the circulating channel.

Further, in the above-described ink-jet recording head, the manifold and the circulating channel overlap with each other in the up-down direction. Accordingly, the above-described ink-jet recording head can be made compact, as compared with a case wherein the manifold and the circulating channel do not overlap with each other in the up-down direction. Furthermore, in the above-described ink-jet recording head, the pressure generating chambers and the circulating channel overlap with each other in the up-down direction. Moreover, the above-described ink-jet recording head is formed by stacking a plurality of plates having through holes, recessed parts, etc., which are to be channels.

SUMMARY

Here, in the above-described ink-jet recording head, the pressure generating chambers and the circulating channel overlap with each other in the up-down direction, as described above. The circulating channel and each of the pressure generating chambers are a relatively large space in the ink-jet recording head. Therefore, in a case that the pressure generating chambers and the circulating channel overlap with each other in the up-down direction, there is such a fear that, when the plurality of plates are stacked, any sufficient load might not be applied to parts around the pressure generating chambers and the circulating channel in the plates, and might lead to any unsatisfactory joining in the plates.

An object of the present disclosure is to provide a liquid discharge head in which two common channels, provided commonly to a plurality of individual channels overlap with each other, and the plates can be joined with each other in an ensured manner.

According to an aspect of the present disclosure, there is provided a liquid discharge head comprising a stacked body which is formed by plates stacked in a first direction and which has a liquid channel, wherein the liquid channel includes: individual channels which include nozzles and pressure chambers communicating with the nozzles, respectively, and which are aligned in a second direction orthogonal to the first direction; a first common channel extending in the second direction and communicating with the individual channels; a second common channel extending in the second direction and communicating with the individual channels; first throttles each of which connects one of the individual channels and the first common channel; and second throttles each of which connects one of the individual channels and the second common channel, the plates include: a nozzle plate having the nozzles; a pressure chamber plate having the pressure chambers; a first common channel plate having the first common channel; and a second common channel plate having the second common channel, the first common channel and the second common channel overlap with each other in the first direction, and the pressure chambers are different from the first and second common channels in positions in a third direction which is orthogonal to the first direction and the second direction, and the pressure chambers do not overlap with the first and second common channels in the first direction.

DESCRIPTION OF THE EMBODIMENTS

In the following, an embodiment of the present disclosure will be explained.

<Overall Configuration of Printer 1>

Figure 1:
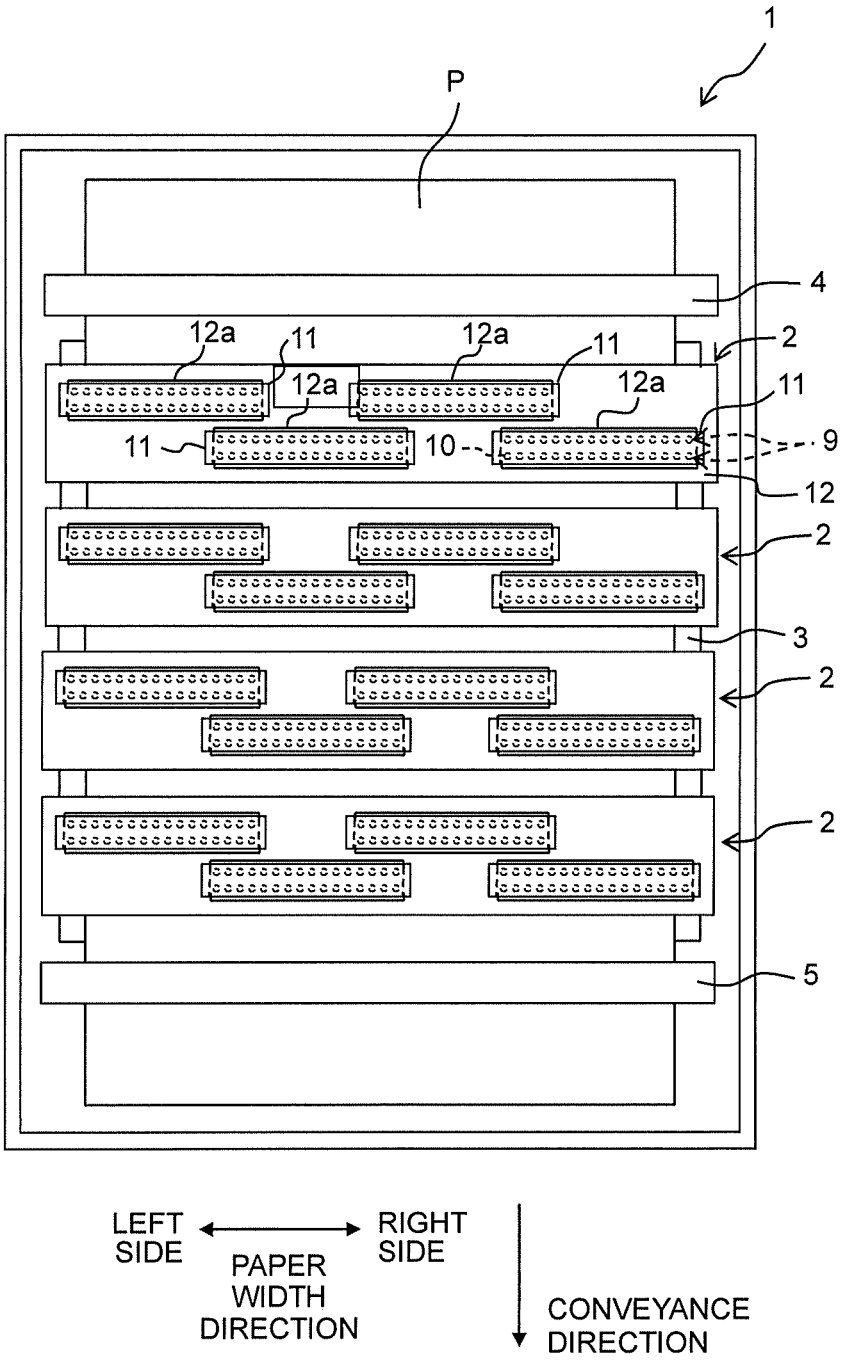
FIG. 1 is a schematic view depicting the configuration of a printer according to an embodiment of the present disclosure.

As depicted in FIG. 1, a printer 1 according to the present embodiment is provided with four ink-jet heads 2, a platen 3 and conveying rollers 4 and 5.

The four ink-jet heads 2 are arranged side by side in a conveyance direction (corresponding to a "third direction" of the present disclosure) which is along a horizontal plane and in which a recording paper sheet P is conveyed by the conveying rollers 4 and 5 as will be described later on. Each of the four ink-jet heads 2 is provided with four head units 11 (corresponding to a "liquid discharge head" of the present disclosure), and a holding member 12. Each of the head units 11 discharges or jets an ink from a plurality of nozzles 10 formed in a lower surface thereof. Here, black, yellow, cyan and magenta inks are discharged from the four ink jet heads 2 in this order from an ink-jet head 2 included in the four ink jet heads 2 and located on the upstream side in the conveyance direction.

Further, in each of the head units 11, the plurality of nozzles 10 are aligned in a paper width direction (corresponding to a "second direction" of the present disclosure) which is along the horizontal plane and which is orthogonal to the conveyance direction to thereby form two nozzle rows 9. The two nozzle rows 9 are arranged side by side in the conveyance direction. Furthermore, in the two nozzle rows 9, the positions of the nozzles 10 in the paper width direction are shifted by half a spacing distance (interval) between the nozzles 10 in each of the nozzle rows 9. Note that the following explanation will be made, with the right side and the left side in the paper width direction being defined as depicted in FIG. 1.

Further, in each of the ink-jet heads 2, two head units 11 among the four head units 11 are arranged side by side in the paper width direction at a spacing distance (interval) therebetween; remaining two head units 11 among the four head units 11 are arranged side by side in the paper width direction at a spacing distance therebetween. Furthermore, among the four head units 11, the two head units arranged side by side in the paper width direction and the remaining two head units 11 arranged side by side in the paper width direction are arranged side by side in the conveyance direction at an interval therebetween. Moreover, the two head units 11 arranged on the upstream side in the conveyance direction and the two head units 11 arranged on the downstream side in the conveyance direction are arranged so that the positions in the paper width direction thereof are shifted. Further, a part of the nozzles 10 in each of the two head units 11 arranged on the upstream side in the conveyance direction overlaps with a part of the nozzles 10 in one of the two head units 11 arranged on the downstream side in the conveyance direction. With this, the plurality of nozzles 10 of the four head units 11 are arranged in the paper width direction over the entire length of the recording paper sheet P. Namely, each of the ink-jet heads 2 is a so-called line head extending in the paper width direction over the entire length of the recording paper sheet P. Note that the detailed configuration of each of the head units 11 will be explained later on.

The holding member 12 is a plate-like member which has a rectangular shape and which is long in the paper width direction; the four head units 11 are fixed to the holding member 12. Further, the holding member 12 is formed with four through holes 12*a* having a rectangular shape and corresponding to the four head units 11, respectively. The plurality of nozzles 10 in the four head units 11 are exposed to the lower side (the side of the recording paper sheet P) via the four through holes 12*a* corresponding thereto respectively.

The platen 3 is arranged at a location below the four the ink-jet heads 2, and faces (is opposite to) the plurality of nozzles 10 of the respective four ink-jet head 2. The platen 3 supports the recording paper sheet P from therebelow. The conveying roller 4 is arranged on the upstream side in the conveyance direction of the four ink-jet heads 2 and the platen 3. The conveying roller 5 is arranged on the downstream side in the conveyance direction of the four ink-jet heads 2 and the platen 3. The conveying rollers 4 and 5 convey the recording paper sheet P in the conveyance direction.

Further, in the printer 1, recording is performed with respect to the recording paper P by causing the four ink-jet heads 2 to discharge (jet) the ink from the plurality of nozzles 10 of the four ink jet head 2 toward the recording paper sheet P, while conveying the recording paper sheet P in the conveyance direction by the conveying rollers 4 and 5.

<Head Unit 11>

Next, the head units 11 will be explained. As depicted in FIGS. 2 to 5, each of the head units 11 is provided with a stacked body 21, a piezoelectric actuator 22 and a protective substrate 23.

The stacked body 21 is formed of plates 31 and 37 which are stacked on top of one another in an up-down direction (corresponding to a "first direction" of the present disclosure). The plate 31 is formed, for example, of a synthetic resin material such as polyimide, etc. Each of the plates 32, 34, 35 and 37 is formed, for example, of silicon (Si). Each of the plates 33 and 36 is formed, for example, of stainless steel, etc. The thicknesses of the plates 31 to 37 are, for example, from this order, approximately 70 μm, approximately 400 μm, approximately 50 μm, approximately 400 μm, approximately 50 μm, approximately 50 μm, and approximately 74 μm, respectively; the total of the thicknesses of the plates 31 to 37 is approximately 1100 μm.

Further, the stacked body 21 is provided with the plurality of nozzles 10, a plurality of pressure chambers 40, a plurality of descenders 41, a plurality of first throttles 42, a plurality of second throttles 43, two first common channels 44, two second common channels 45, bypass channels 46 to 49, and connecting channels 50 and 51.

The plurality of nozzles 10 are formed in the plate 31 (corresponding to a "nozzle plate" of the present disclosure). The plurality of nozzles 10 form the two nozzle rows 9, as described above.

The plurality of pressure chambers 40 correspond to the plurality of nozzles 10, respectively, and the plurality of pressure chambers 40 are formed in the plate 37 (corresponding to a "pressure chamber plate" of the present disclosure). Each of the plurality of pressure chambers 40 has a shape of a rectangle in a plan view which is long in the conveyance direction, and overlaps, in the up-down direction, with a (certain) nozzle 10 included in the plurality of nozzles 10 and corresponding thereto. To provide more detailed explanation, pressure chambers 40 included in the plurality of pressure chambers 40 and corresponding to nozzles 10 constructing a nozzle row 9, among the two nozzle rows 9, on the upstream side in the conveyance direction each overlap, at an end thereof on the downstream side in the conveyance direction, with one of the nozzles 10 in the up-down direction. Further, pressure chambers 40 included in the plurality of pressure chambers 40 and corresponding to nozzles 10 constructing a nozzle row 9, among the two nozzle rows 9, on the downstream side in the conveyance direction each overlap, at an end thereof on the upstream side in the conveyance direction, with one of the nozzles 10. With this, in each of the head units 11, two pressure chamber rows 8 corresponding to the two nozzle rows 9, respectively, are formed. Namely, the two pressure chamber rows 8 are arranged side by side in the conveyance direction, and each of the two pressure chamber rows 8 is formed of the pressure chambers 40 aligned in the paper width direction.

The plurality of descenders 41 correspond to the plurality of nozzles 10, respectively. Each of the plurality of descenders 41 extends in the up-down direction through the plates 32 to 37 and connects one of the plurality of nozzles 10 corresponding thereto and one of the plurality of pressure chambers 40.

The plurality of first throttles 42 correspond to the plurality of pressure chambers 40, respectively. Each of the plurality of first throttles 42 extends in the up-down direction at a part, of the plate 36, which overlaps with an end part in the conveyance direction of one of the plurality of pressure chambers 40 corresponding thereto, the end part being on a side opposite to one of the plurality of nozzles 10. Further, each of the plurality of first throttles 42 is bent or curved in a lower end part thereof, and extends towards the outside in the conveyance direction of the head unit 11.

The plurality of second throttles 43 correspond to the plurality of descenders 41, respectively. Each of the plurality of second throttles 43 is formed in a lower end part of the plate 34, and is connected to one of the plurality of descenders 41 corresponding thereto. Further, each of the plurality of second throttles 43 extends toward the outside in the conveyance direction of the head unit 11, from a connection part of each of the plurality of second throttles 43 at which each of the plurality of second throttles 43 is connected to one of the plurality of descenders 41 corresponding thereto. In the present embodiment, the plurality of second throttles 43 are arranged in such a manner as descried above, thereby allowing the plurality of second throttles 43 to overlap with the plurality of pressure chambers 40, respectively, in the up-down direction.

Further, in the present embodiment, a certain nozzle 10 among the plurality of nozzles 10, one of the plurality of pressure chambers 40, one of the plurality of descenders 41, one of the plurality of first throttles 42 and one of the plurality of second throttles 43 each corresponding to the certain nozzle 10 form an individual channel 20. Furthermore, in the head unit 11, two individual channel rows 7 which are arranged side by side in the conveyance direction are formed. Each of the two individual channel rows 7 is formed of a plurality of pieces of the individual channel 20 aligned in the paper width direction.

The two first common channels 44 correspond to the two individual channel rows 7, respectively. The two first common channels 44 are arranged in parts, of the plate 36 (corresponding to a "first common channel plate" of the present disclosure), located outside in the conveyance direction relative to the two pressure chamber rows 8. Each of the first common channels 44 extends in the paper width direction to be longer than one of the two pressure chamber rows 8 corresponding thereto. Further, an end part on the inside in the conveyance direction of each of the two first common channels 44 is connected to parts, of the plurality of first throttles 42, extending in the conveyance direction. With this, each of the two first common channels 44 does not overlap with the pressure chambers 40 in the up-down direction.

Further, the two first common channels 44 are formed of recessed parts, respectively, which are opened in the lower surface of the plate 36. Furthermore, another parts, of the plate 36, located above the two first common channels 44, respectively, are dampers 36*a* (corresponding to a "first damper" of the present disclosure) of which thickness is thinned and which are elastically deformable. Moreover, parts, of the plate 37, overlapping in the up-down direction with the dampers 36*a*, respectively, are formed with damper chambers 37*a* which receive upward elastic deformation of the dampers 36*a*, respectively.

In the present embodiment, the plate 37 formed with the plurality of pressure chambers 40 and the plate 36 formed with the two first common channels 44 are joined to each other directly. Furthermore, a distance L in the conveyance direction between an end, of each of the plurality of pressure chambers 40, on the side of the first common channel 44 and an end, of the first common channel 44, on the side of the plurality of pressure chambers 40 is not less than 200 μm.

The two second common channels 45 correspond to the two individual channel rows 7, respectively. The two second common channels 45 are arranged in parts, of the plate 34 (corresponding to a "second common channel plate" of the present disclosure), overlapping in the up-down direction with the two first common channels 44, respectively, and each of the two second common channels 45 extends in the paper width direction to be longer than one of the pressure chamber rows 8. With this, each of the two second common channels 45 does not overlap with the pressure chambers 40 in the up-down direction.

Corresponding to the above-described arrangement of each of the two second common channels 45 as described above, the plate 33 is formed with recessed parts 33*a* which are opened in the lower surface of the plate 33 and which are located at parts, of the plate 33, overlapping in the up-down direction with the two second common channels 45, respectively. With this, another parts, of the plate 33, which are located between the two second common channels 45 and the recessed parts 33*a*, respectively, are dampers 33*b* (corresponding to a "second damper" of the present disclosure) which are elastically deformable so as to suppress any fluctuation in the pressure of the ink inside the two second common channels 45. Furthermore, the recessed parts 33*a* are damper chambers which receive downward elastic deformation of the dampers 33*b*, respectively. Moreover, lower ends of the recessed parts 33*a* are covered by the plate 32.

In the present embodiment, the position in the conveyance direction of connection parts at which each of the plurality of second throttles 43 is connected to the second common channel 45 is made to be same as the position in the conveyance direction of one end of the plate 31 formed with the plurality of nozzles 10. With this, the plate 31 does not overlap in the up-down direction with the two second channels 45.

Figure 2:
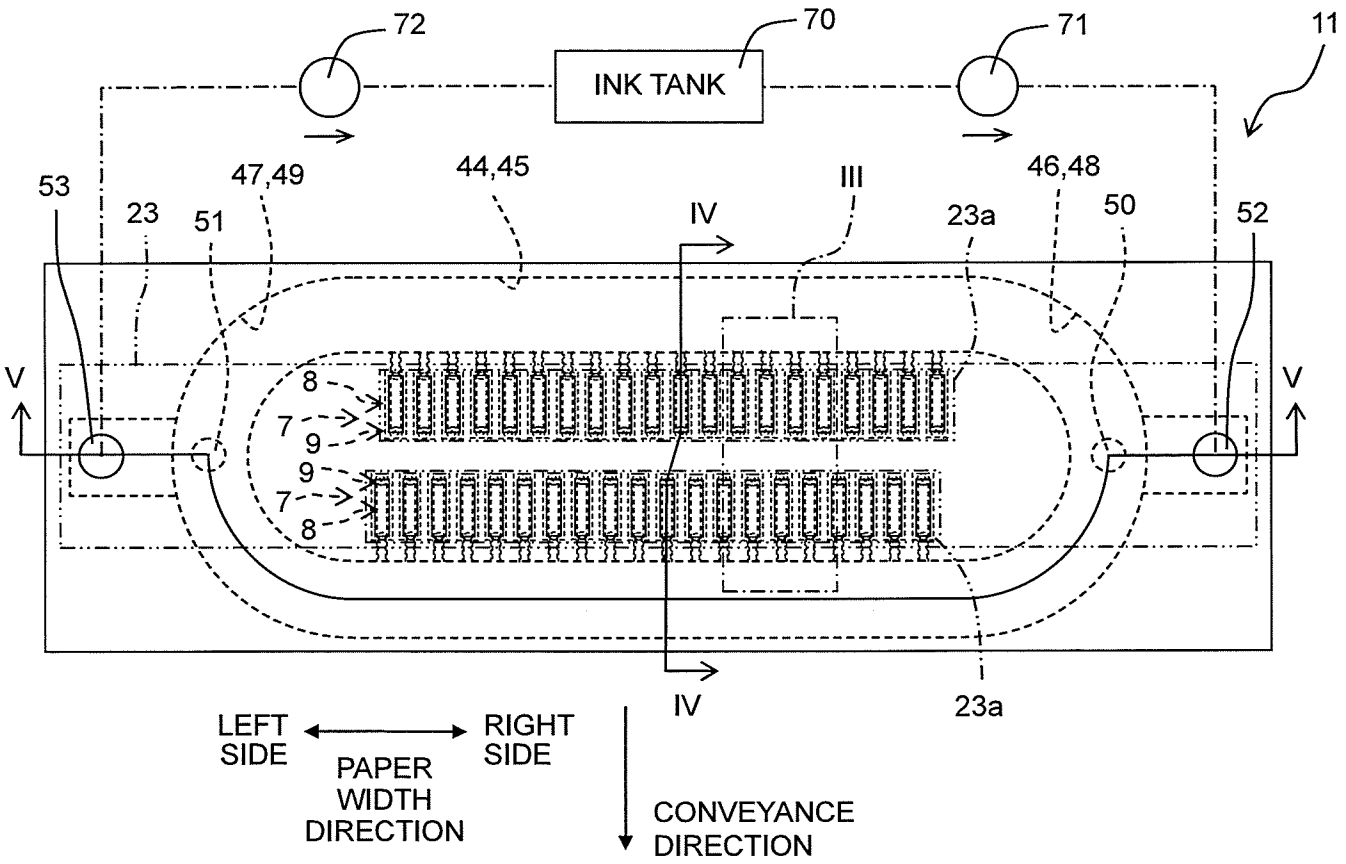
FIG. 2 is a plan view of a head unit depicted in FIG. 1.
Figure 3:
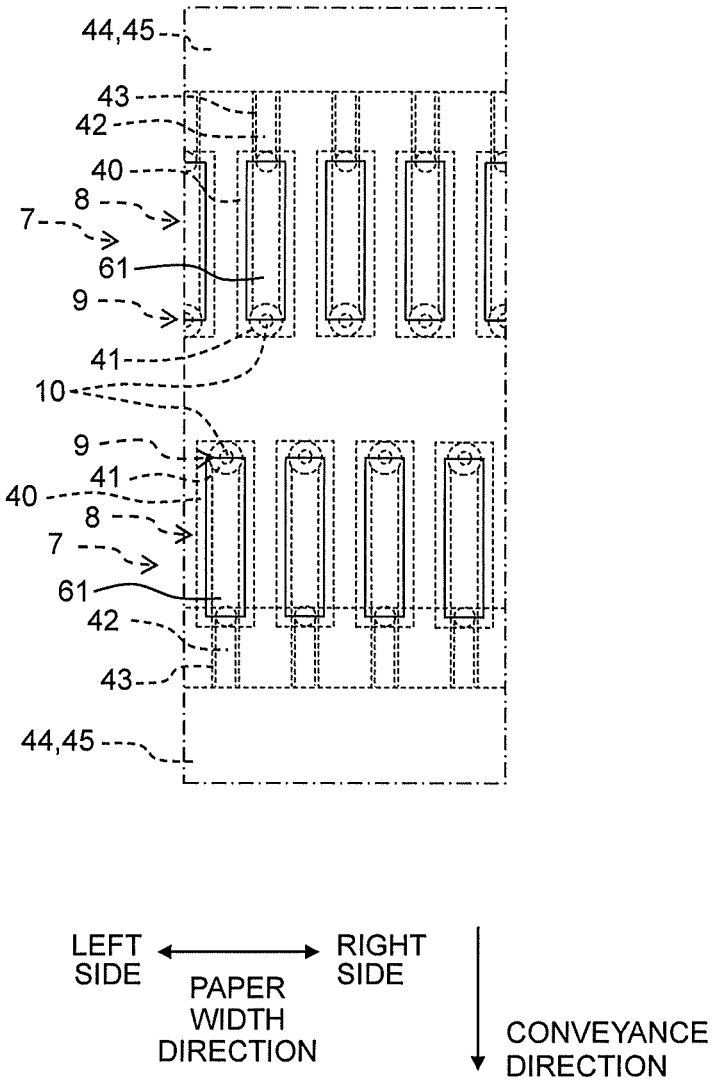
FIG. 3 is an enlarge view of a part III in FIG. 2.
Figure 4:
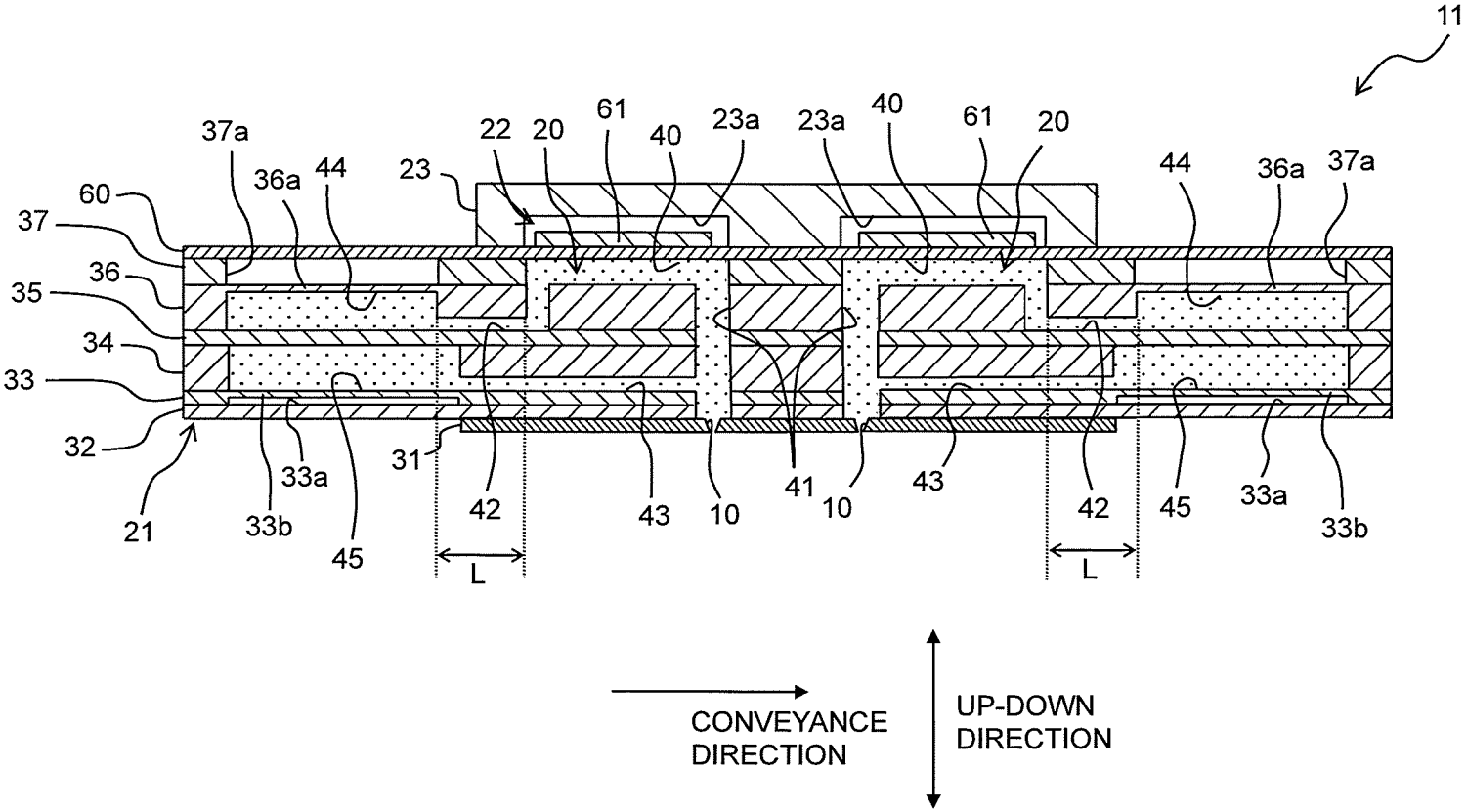
FIG. 4 is a cross-sectional view taken along a line IV-IV in FIG. 2.
Figure 5:
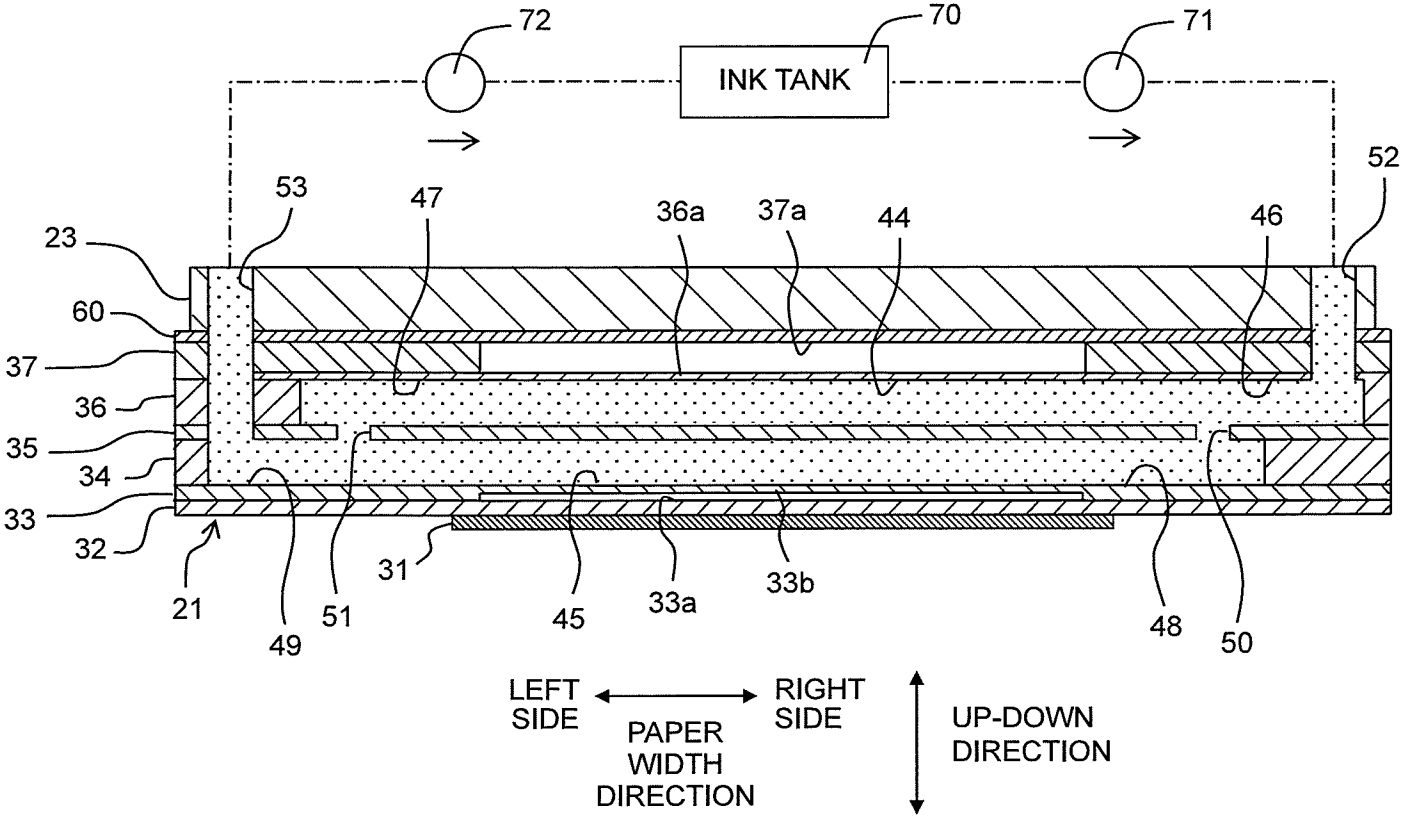
FIG. 5 is a cross-sectional view taken along a line V-V in FIG. 2.
Figure 6:
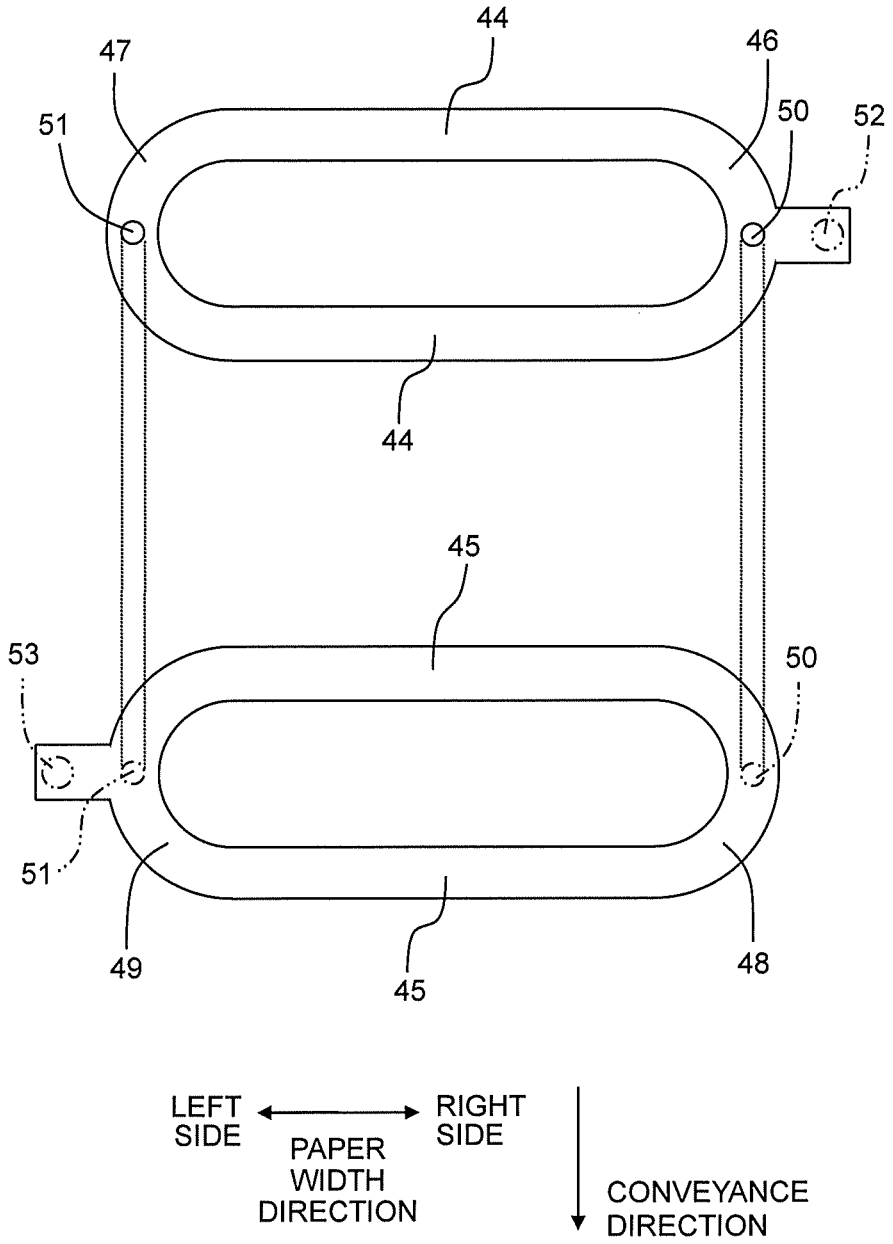
FIG. 6 is a view for explaining a first common channel and a second common channel.

As depicted in FIGS. 2, 5 and 6, the bypass channel 46 (corresponding to a "first inflow bypass channel" of the present disclosure) is formed in the plate 36 and connects right ends in the paper width direction (corresponding to "ends on one side in the second direction" of the present disclosure) of the two first common channels 44 with each other. Further, the bypass channel 46 extends while being curved to project toward the right side in the paper width direction. The bypass channel 47 (corresponding to a "second inflow bypass channel" of the present disclosure) is formed in the plate 36 and connects left ends in the paper width direction (corresponding to "ends on the other side in the second direction" of the present disclosure) of the two first common channels 44 with each other. Further, the bypass channel 47 extends while being curved to project toward the left side in the paper width direction.

The bypass channel 48 (corresponding to a "second outflow bypass channel" of the present disclosure) is formed in the plate 34 and connects right ends in the paper width direction of the two second common channels 45 with each other. Further, the bypass channel 48 extends while being curved to project toward the right side in the paper width direction. The bypass channel 49 (corresponding to a "first outflow bypass channel" of the present disclosure) is formed in the plate 34 and connects left ends in the paper width direction of the two second common channels 45 with each other. Further, the bypass channel 49 extends while being curved to project toward the left side in the paper width direction.

The connecting channel 50 (corresponding to a "second connecting channel" of the present disclosure) is formed in the plate 35, and extends in the up-down direction so as to connect the bypass channel 46 and the bypass channel 48 with each other. The connecting channel 51 (corresponding to a "first connecting channel" of the present disclosure) is formed in the plate 35, and extends in the up-down direction so as to connect the bypass channel 47 and the bypass channel 49 with each other.

<Piezoelectric Actuator 22>

The piezoelectric actuator 22 is provided with a vibration plate 60 and a plurality of piezoelectric elements 61. The vibration plate 60 extends continuously over the entire area of the upper surface of the plate 37, and covers the plurality of pressure chambers 40 and the damper chambers 37*a*. The vibration plate 60 is composed of silicon dioxide ($SiO^2$) or silicon nitride (SiN); the vibration plate 60 is formed by oxidizing or nitriding an upper end part of the plate 37. The plurality of piezoelectric elements 61 correspond to the plurality of pressure chambers 40, respectively. Each of the plurality of piezoelectric elements 61 is arranged in a part, of the upper surface of the vibration plate 60, overlapping in the up-down direction with a central part or portion of one of the plurality of pressure chambers 40 corresponding thereto.

Here, each of the plurality of piezoelectric elements 61 is formed of a piezoelectric body formed of a piezoelectric material containing, as a main component thereof, lead zirconate titanate which is a mixed crystal of lead titanate and lead zirconate; an electrode configured to generate an electric field in the piezoelectric body; etc. The piezoelectric body in each of the piezoelectric elements 61 is piezoelectrically deformed to thereby cause each of the piezoelectric elements 61 and a part of the vibration plate 60 which overlaps with a certain pressure chamber 40 among the plurality of the pressure chambers 40 and corresponding to each of the piezoelectric elements 61 in the up-down direction to deform so as to project toward the certain pressure chamber 40. As a result, the volume of the certain pressure chamber 40 becomes small, which in turn increases the pressure of the ink inside the certain pressure chamber 40, thereby discharging the ink from a certain nozzle 10 included in the nozzles 10 and corresponding to the certain pressure chamber 40. Note, however, that the construction and the operation of the piezoelectric element 61 are similar to those of a conventional piezoelectric element, and thus any further detailed explanation therefor will be omitted.

<Protective Substrate 23>

The protective substrate 23 is arranged on the upper surface, of the vibration plate 60, on which the plurality of piezoelectric elements 61 are arranged. Two recessed parts 23*a* corresponding to the two pressure chamber rows 8, respectively, are formed in the protective substrate 23. Each of the two recessed parts 23*a* extends in the paper width direction along and over the pressure chambers 40 constructing one of the two pressure chamber rows 8 corresponding thereto, and covers the piezoelectric elements 61 corresponding to the pressure chambers 40 constructing one of the pressure chamber rows 8.

In joining parts at which the protective substrate 23 and the vibration plate 60 (stacked body 21) are joined to each other, a joining part on one side in the conveyance direction is located between the pressure chambers 40 forming the pressure chamber row 8 on the one side in the conveyance direction and the first and second common channels 44 and 45 on the one side in the conveyance direction. Similarly, in the joining parts at which the protective substrate 23 and the vibration plate 60 (stacked body 21) are joined to each other, a joining part on the other side in the conveyance direction is located between the pressure chambers 40 forming the pressure chamber row 8 on the other side in the conveyance direction and the first and second common channels 44 and 45 on the other side in the conveyance direction. With this, the respective joining parts between the protective substrate 23 and the vibration plate 60 overlap with the plurality of first throttles 42 and the plurality of second throttles 43 in the up-down direction, but do not overlap with the two first common channels 44 and the two second common channels 45 in the up-down direction.

<Supply Channel 52 and Discharge Channel 53>

Further, as depicted in FIGS. 2, 5 and 6, the head unit 11 is provided with a supply channel 52 and a discharge channel 53. The supply channel 52 extends, in the up-down direction, in a central part in the conveyance direction of each of the plate 37, the vibration plate 60 and the protective substrate 23, at a right end part in the paper width direction of each of the plate 37, the vibration plate 60 and the protective substrate 23. Further, the supply channel 52 is further bent or curved at a lower end part thereof and extends toward the left side in the paper width direction, and is connected to a right end part in the paper width direction of the bypass channel 46.

Further, an upper end part of the supply channel 52 is connected to an ink tank 70 via a non-depicted channel. The ink tank 70 is connected to a non-depicted ink cartridge via a non-depicted tube, etc., and the ink is supplied from the ink cartridge to the ink tank 70. Further, a pump 71 is provided on an intermediate part of the channel between the supply channel 52 and the ink tank 70. The pump 71 feeds the ink from the ink tank 70 toward the supply channel 52.

The discharge channel 53 extends, in the up-down direction, in central part in the conveyance direction of each of the plates 35 to 37, the vibration plate 60 and the protective substrate 23, at a left end part in the paper width direction of each of the plates 35 to 37, the vibration plate 60 and the protective substrate 23. The discharge channel 53 is further bent or curved at a lower end part thereof and extends toward the right side in the paper width direction, and is connected to a left end part in the paper width direction of the bypass channel 49.

Further, an upper end part of the discharge channel 53 is connected to the ink tank 70 via a non-depicted channel. Furthermore, a pump 72 is provided on an intermediate part of the channel between the discharge channel 53 and the ink tank 70. The pump 72 feeds the ink from the discharge channel 53 toward the ink tank 70.

In a case that the pumps 71 and 72 are driven to thereby feed the ink, the ink inside the ink tank 70 is supplied from the supply channel 52 to the head unit 11, and then the ink is allowed to flow into the two first common channels 44 mainly via the supply channel 52 and the bypass channel 46.

The ink inside the respective first common channels 44 mainly flows from the plurality of first throttles 42 to the plurality of individual channels 20, respectively. The ink inside the plurality of individual channels 20 flows out from the plurality of second throttles 43 into the inside of the respective second common channels 45. The ink inside the respective second common channels 45 is discharged mainly from the discharge channel 53 and returns to the ink tank 70. With this, the ink is circulated between the head unit 11 and the ink tank 70.

Further, in the above-described situation, a part of the ink flows between the bypass channel 46 and the bypass channel 48 via the connecting channel 50. Further, another part of the ink flows between the bypass channel 47 and the bypass channel 49 via the connecting channel 51.

Figure 7A:
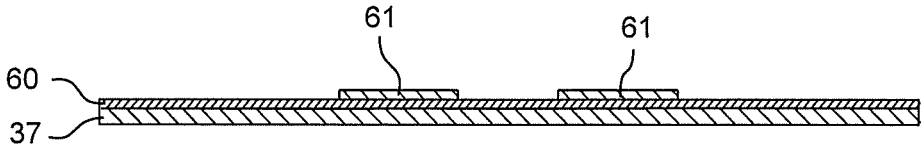
FIG. 7A is a view for explaining a step of forming a vibration plate and piezoelectric elements in a plate.
Figure 7B:
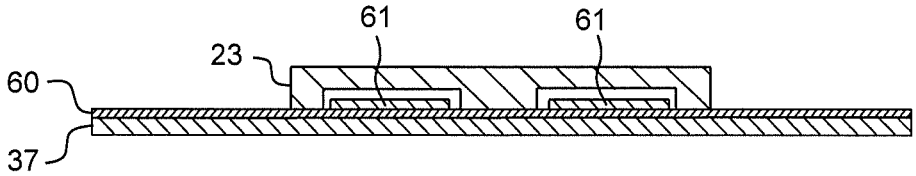
FIG. 7B is a view for explaining a step of joining the plate and a protective substrate.

Here, a method of producing the head unit 11 will be explained. In order to produce the head unit 11, for example, firstly as depicted in FIG. 7A, an upper end part of the plate 37, in a state before the pressure chambers 40 and the damper chambers 37*a* are formed in the plate 37, is oxidized or nitrided so as to form the vibration plate 60; and the plurality of piezoelectric elements 61 are formed in the upper surface of the vibration plate 60. Then, as depicted in FIG. 7B, the protective substrate 23 is joined to the vibration plate 60 (plate 37) having the plurality of piezoelectric elements 61 formed therein, to thereby preparing a stacked body.

Figure 7C:
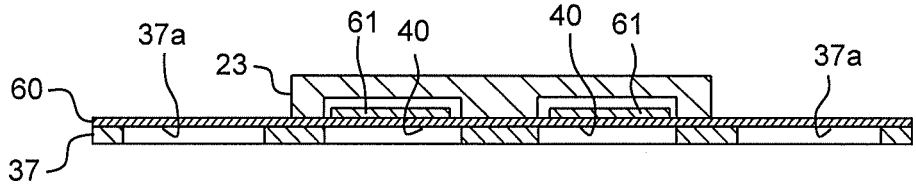
FIG. 7C is a view for explaining a step of forming pressure chambers and damper chambers in the plate.
Figure 7D:
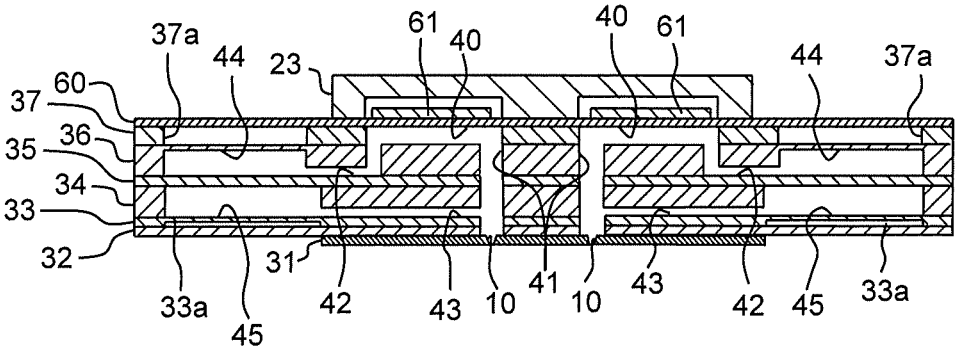
FIG. 7D is a view for explaining a step of joining a plurality of plates to a stacked body of the plate and the protective substrate.

Subsequently, as depicted in FIG. 7C, the plurality of pressure chambers 40 and the two damper chambers 37*a* are formed, for example, by etching, in the plate 37. Next, as depicted in FIG. 7D, the plates 31 to 36 formed with a plurality of through holes and a plurality of recessed parts which are to become the plurality of nozzles 10, the plurality of descenders 41, the plurality of first throttles 42, the plurality of second throttles 43, the two first common channels 44, the two second common channels 45 and the two damper chambers 33*a* are joined to the stacked body of the plate 37 and the protective substrate 23.

In this situation, for example, after stacking and joining the stacked body of the plate 37 and the protective substrate 23 with the plates 32 to 36, the plate 31 is joined to the stacking body of the plates 32 to 37 and the protective substrate 23. Alternatively, it is also allowable to join the plates 31 to 36 one by one in a sequential manner to the stacked body of the plate 37 and the protective substrate 23. Still alternatively, it is allowable to stack the plates 31 to 36 to the stacked body of the plate 37 and the protective substrate 23, then to be joined altogether at a time. With this, the head unit 11 is completed.

Effects

In the embodiment as described above, the two first common channels 44 overlap in the up-down direction with the two second common channels 45, respectively. With this, it is possible to make the size in the conveyance direction of the head unit 11 to be small, as compared with a case of arranging the two first common channels 44 and the two second common channels 45 to be shifted in the conveyance direction.

Note, however, that each of the two first common channels 44, each of the two second common channels 45 and each of the pressure chambers 40 are a relatively large space in the head unit 11. Therefore, in a case that the two first common channels 44 overlap in the up-down direction with the two second common channels 45, respectively, and further that, unlike in the present embodiment, any one of the two first common channel 44 and the two second common channels 45 overlap with the plurality of pressure chambers 40 in the up-down direction, there is such a fear that, when the plurality of plates 31 to 37 are staked onto one another and joined to one another, any sufficient load might not be applied to parts, of the plates 31 to 37, which are located around the plurality of pressure chambers 40 and the two first common channels 44 and the two second common channels 45.

In contrast, in the present embodiment, the plurality of pressure chambers 40 do not overlap, in the up-down direction, with the two first common channels 44 and the two second common channels 45. With this, in a case that the plurality of plates 31 to 37 are stacked onto one another and are joined to one another, it is possible to apply sufficient load to the parts, of the plates 31 to 37, which are located around the plurality of pressure chambers 40 and the two first common channels 44 and the two second common channels 45.

Further, in the present embodiment, the ink is allowed to flow from each of the two first common channels 44 to the individual channels 20 and the ink is allowed to flow out from the individual channels 20 to one of the two second common channels 45 corresponding thereto, thereby making it possible to circulate the ink between the head unit 11 and the ink tank 70.

Furthermore, in each of the plurality of individual channels 20 of the present embodiment, one of the nozzles 10 and one of the pressure chambers 40 overlapping with each other in the up-down direction are connected by one of the descenders 41 extending in the up-down direction; each of the first throttles 42 connects one of the pressure chambers 40 to the first common channel 44; and each of the second throttles 43 extends in the conveyance direction and connects one of the descenders 41 to the second common channel 45. In such a case, there is provided the configuration wherein the pressure chambers 40 and the first and second common channels 44 and 45 are not allowed to overlap with one another in the up-down direction, and the pressure chambers 40 and the second throttles 43 are allowed to overlap with one another in the up-down direction, thereby making it possible to apply sufficient load to the parts, of the plurality of plates 31 to 37, which are located around the pressure chambers 40 and the first and second common channels 44 and 45 in a case that the plurality of plates 31 to 37 are joined to one another.

Moreover, in each of the plurality of individual channels 20 of the present embodiment, the plurality of first throttles 42 and the plurality of second throttles 43 overlap, in the up-down direction, with the joining parts of the protective substrate 32 at which the protective substrate 32 is joined to the vibration plate 60 (stacked body 21). With this, in the case that the protective substrate 23 and the vibration plate 60 are joined to each other, it is possible to apply sufficient load to the joining parts at which the protective substrate 23 and the vibration plate 60 to each other, as compared with a case wherein the joining parts at which the protective substrate 23 and the vibration plate 60 are jointed to each other overlap, in the up-down direction, with the first and second common channels 44 and 45.

Further, in the present embodiment, the plate 31 overlaps in the up-down direction with the plurality of second throttles 43; and the positions on the both sides in the conveyance direction of the plate 31 are same with the positions in the conveyance direction of the joining parts at which the plurality of second throttles 45*a* are joined to the two second common channels 45. Accordingly, the plate 31 does not overlap with the two second common channels 45 in the up-down direction. With this, in the case of joining the plates 31 to 37, it is possible to apply sufficient load to a joining part between the plate 31 and the plate 32 which is to be joined thereto. Further, the plate 31 can be made large as maximally possible in the conveyance direction within a range in which the plate 31 does not overlap with the two second common channels 45 in the up-down direction, thereby making it possible to secure the joining area between the plates 31 and 32.

Further, in a case that, as in the present embodiment, the plate 37 formed with the plurality of pressure chambers 40 and the plate 36 formed with the two first common channels 44 are joined, and that, unlike the present embodiment, the plurality of pressure chambers 40 overlap in the up-down direction with the two first common channels 44 and the two second common channels 45, there is no plate between the plate 37 formed with the plurality of pressure chambers 40 and the plate 36 formed with the two first common channels 44. Thus, in a case of stacking and joining the plates 31 to 37 to one another, it is difficult to apply load to a part, of the plate 37, located around the plurality of pressure chambers 40 and to a part, of the plate 36, located around the two first common channels 44.

In contrast, in the present embodiment, the plate 37 formed with the plurality of pressure chambers 40 and the plate 36 formed with the two first common channels 44 are joined, and no other plate is arranged between the plates 37 and 36; however, the plurality of pressure chambers 40 do not overlap with the two first common channels 44 and the two second common channels 45 in the up-down direction. This makes it possible to apply sufficient load to the part, of the plate 37, located around the plurality of pressure cambers 40 and to the part, of the plate 36, located around the two first common channels 44.

Further, in a case that the plate 37 formed with the plurality of pressure chambers 40 and the plate 36 formed with the two first common channels 44 are joined as in the present embodiment, and further that the parts, of the plates 36 and 37, each of the parts being located between one of the pressure chambers 40 and the first common channel 40 in the conveyance direction, have a length in the conveyance direction (distance L) which is too short relative to the thickness thereof, then the strength in these parts of the plates 36 and 37 becomes weak. Accordingly, in the case of stacking and joining the plates 31 to 37 to one another, the above-described parts in the plates 36 and 37 are easily broken or damaged. In contrast, in the present embodiment, the distance L in the conveyance direction of the above-described parts is made to be not less than 200 μm. With this, the strength of the above-described parts of the plates 36 and 37 is enhanced, thereby making it possible to prevent any breakage or damage in the above-described parts of the plates 36 and 37.

Furthermore, in the present embodiment, the dampers 36*a* are provided with respect to the first common chambers 44, respectively, thereby making it possible to suppress any fluctuation in the pressure of the ink inside each of the first common channels 44. Moreover, in the present embodiment, the dampers 33*a* are provided with respect to the second common chambers 45, respectively, thereby making it possible to suppress any fluctuation in the pressure of the ink inside each of the second common channels 45.

Further, in the present embodiment, the right ends in the paper width direction of the two first common channels 44 are connected to each other via the bypass channel 46, and the supply channel 52 common to the two first common channels 44 is provided on the bypass channel 46. Accordingly, it is possible to simplify the structure of the channels, as compared with a case of providing supply channels individually for the two first common channels 44, respectively.

Furthermore, in the present embodiment, the left ends in the paper width direction of the two second common channels 45 are connected to each other via the bypass channel 49, and the discharge channel 53 common to the two second common channels 45 is provided on the bypass channel 49. Accordingly, it is possible to simplify the structure of the channels, as compared with a case of providing discharge channels individually for the two second common channels 45, respectively.

Moreover, in the present embodiment, in addition that the right ends in the paper width direction of the two first common channels 44 are connected to each other via the bypass channel 46, the left ends in the paper width direction of the two first common channels 44 are connected to each other via the bypass channel 47. With this, any part which could be a dead end part (no-through part) is not present in each of the two first common channels 44, thereby making it possible to prevent the ink from remaining in each of the two first common channels 44.

Further, in the present embodiment, in addition that the left ends in the paper width direction of the two second common channels 45 are connected to each other via the bypass channel 49, the right ends in the paper width direction of the two second common channels 45 are connected to each other via the bypass channel 48. With this, any part which could be a dead end part (no-through part) is not present in each of the two second common channels 45, thereby making it possible to prevent the ink from remaining in the two second common channels 45.

Furthermore, in the present embodiment, the bypass channel 47 and the bypass channel 49 are connected to each other via the connecting channel 51. This allows the ink to flow from the bypass channel 47 to the bypass channel 49, thereby making it possible to prevent, more effectively, the ink from remaining in the bypass channel 47. Moreover, by allowing any air bubbles in the inside of the first common channels 44 to flow to the second common channels 45 via the bypass channel 47, the connecting channel 51 and the bypass channel 49, it is possible to allow any air bubbles in the inside of the first common channels 44 to the second common channels 45, not via the individual channels 20. With this, it is possible to make any air bubbles to less likely to flow into the individual channels 20.

Further, in the present embodiment, the bypass channel 46 and the bypass channel 48 are connected to each other via the connecting channel 50. This allows the ink to flow from the bypass channel 48 to the bypass channel 46, thereby making it possible to prevent, more effectively, the ink from remaining in the bypass channel 48.

<Modifications>

In the foregoing, the embodiment of the present disclosure has been explained. The present disclosure, however, is not limited to or restricted by the above-described embodiment; a variety of kinds of changes are possible, within the range described in the claims.

In the above-described embodiment, the right ends in the paper width direction of the two first common channels 44 are connected to each other via the bypass channel 46, and the left ends in the paper width direction of the two first common channels 44 are connected to each other via the bypass channel 47. Further, the right ends in the paper width direction of the two second common channels 45 are connected to each other via the bypass channel 48, and the left ends in the paper width direction of the two second common channels 45 are connected to each other via the bypass channel 49. Furthermore, the bypass channel 46 and the bypass channel 48 are connected to each other via the connecting channel 50, and the bypass channel 47 and the bypass channel 49 are connected to each other via the connecting channel 51. The present disclosure, however, is not limited to this configuration.

For example, the head unit may be provided with not less than three individual channel rows, not less than three first common channels corresponding to the not less than three individual channel rows, respectively, and not less than three second common channels corresponding to the not less than three individual channel rows, respectively. Further, ends in the paper width direction of the not less than three first common channels may be connected to one another via bypass channels, respectively, and ends in the paper width direction of the not less than three second common channels may be connected to one another via bypass channels, respectively.

Further, for example, it is allowable that the connecting channel 50 connecting the bypass channel 46 and the bypass channel 48 is not provided. Furthermore, in such a case, it is allowable that the bypass channel 48 is not provided. Moreover, it is allowable that the connecting channel 51 connecting the bypass channel 47 and the bypass channel 49 is not provided. Furthermore, in such a case, it is allowable that the bypass channel 47 is not provided.

Moreover, it is allowable that the bypass channel 49 connecting the two second common channels 45 is not provided. For example, discharge channels may be individually provided on the two second common channels 45, respectively. Further, it is allowable that the bypass channel 46 connecting the two first common channels 44 is not provided. For example, supply channels may be individually provided on the two first common channels 44, respectively.

Moreover, in the above-described embodiment, the dampers 36*a* are provided with respect to the first common channels 44, respectively, and the dampers 33*b* are provided with respect to the second common channels 45, respectively. The present disclosure, however, is not limited to this configuration. It is allowable that a least one of the dampers 36*a* and the dampers 33*b* are not provided.

Further, in the above-described embodiment, the plate 37 formed with the plurality of pressure chambers 40 and the plate 36 formed with the two first common channels 44 are joined directly to each other. Further, in the conveyance direction, the distance L between the ends on the one side in the conveyance direction, of the pressure chambers 40 constructing the pressure chamber row 8 on the one side in the conveyance direction, and the ends on the other side in the conveyance direction of the first common channel 44 on the one side in the conveyance direction is not less than 200 μm. Further, in the conveyance direction, the distance L between the ends on the other side in the conveyance direction, of the pressure chambers 40 constructing the pressure chamber row 8 on the other side in the conveyance direction, and the ends on the one side in the conveyance direction of the first common channel 44 on the other side in the conveyance direction is not less than 200 μm. The present disclosure, however, is not limited to this configuration.

For example, in a case that the thicknesses of the plates 37 and 36 are great, the distance L may be less than 200 μm. Further, another plate may be arranged between the plate 37 formed with the plurality of pressure chambers 40 and the plate 36 formed with the two first common channels 44.

Further, in the above-described embodiment, the both ends in the conveyance direction of the plate 31 formed with the plurality of nozzles 31 overlap, in the up-down direction, with the joining parts of the plurality of second throttles 43 with respect to the two second common channels 45, and that the plate 31 does not overlap in the up-down direction with the two second common channels 45. The present disclosure, however, is not limited to this configuration. For example, in the conveyance direction, the both ends of the plate 31 may be located on the inner side relative to the joining parts of the plurality of second throttles 43 with respect to the second common channels 45. Alternatively, the plate 31 may extend up to a position at which the plate 31 overlaps, in the up-down direction, with the two first common channels 44 and the two second common channels 45.

Furthermore, in the above-described embodiment, the joining part at which the protective substrate 23 and the vibration plate 60 are joined to each other overlaps, in the up-down direction, with the plurality of first throttles 42 and the plurality of second throttles 43, and the joining part does not overlap, in the up-down direction, with the two first common channels 44 and the two second common channels. The present disclosure, however, is not limited to this configuration.

For example, it is allowable that the joining part at which the protective substrate 23 and the vibration plate 60 are joined to each other does not overlap, in the up-down direction, with at least one of the plurality of first throttles 42 and the plurality of second throttles 43. Further, it is allowable that the joining part at which the protective substrate 23 and the vibration plate 60 are joined to each other overlaps in the up-down direction with at least one of the two first common channels 44 and the two second common channels 45.

Moreover, in each of the individual channels 20 in the above-described embodiment, the nozzles 10 and the pressure chambers 40 are connected to one another via the descenders 41 extending in the up-down direction, respectively. The present disclosure, however, is not limited to this configuration. For example, the present disclosure is applicable also to a head unit in which the nozzles 10 and the pressure chambers 40 are directly connected to one another, respectively.

Figure 8:
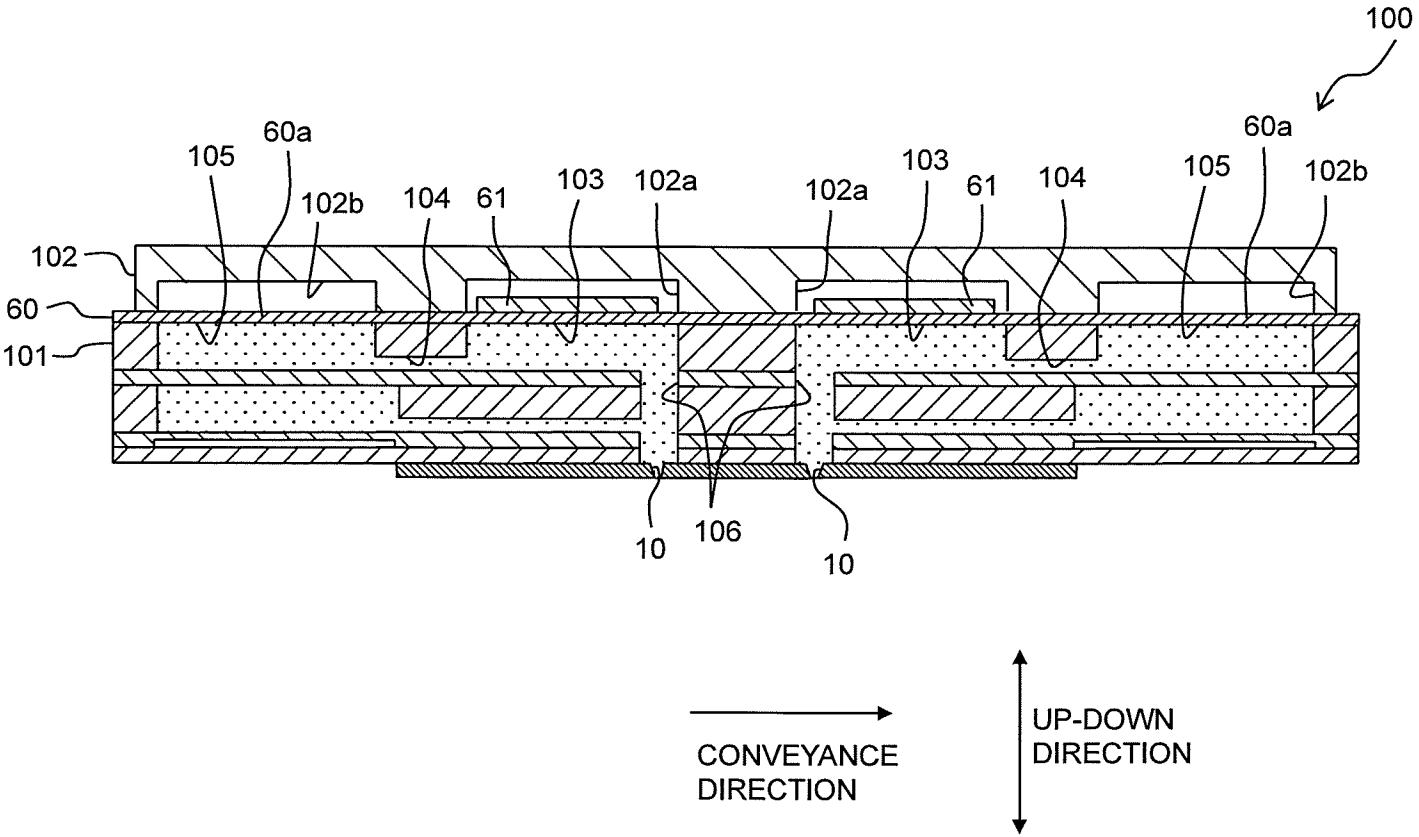
FIG. 8 is a cross-sectional view of a head unit according to a modification, corresponding to FIG. 4.

Further, in the above-described example, both of the first and second throttles overlap, in the up-down direction, with each of the pressure chambers 40. The present disclosure, however, is not limited to this configuration. In head unit 100 of a modification as depicted in FIG. 8, the plates 36 and 37 in the head unit 11 are replaced by a plate 101, and the protective substrate 23 in the head unit 11 is replaced by a protective substrate 102. Note that in the modification, the vibration plate 60 is formed by oxidizing or nitriding an upper end part of the plate 101.

The plate 101 is formed with: a plurality of pressure chambers 103 forming two pressure chamber rows, a plurality of first throttles 104 communicating with the plurality of pressure chambers 103, respectively, and two first common channels 105 provided with respect to the two pressure chamber rows, respectively. The plurality of pressure chambers 103, the plurality of first throttles 104 communicating with the plurality of pressure chambers 103, respectively, and the two first common channels 105 are arranged side by side in the conveyance direction; and the first throttles 104 are arranged between the pressure chambers 103 and the first common channels 105 in the conveyance direction. Further, each of the first throttles 104 extends in the conveyance direction and connects one of the pressure chambers 103 to the first common channel 105. In this case, although each of the pressure chambers 103 overlaps, in the up-down direction, with one of the second throttles 43, each of the pressure chambers 103 does not overlap, in the up-down direction, with one of the first throttles 104. Moreover, in this modification, descenders 106 extend in the up-down direction through the plates 32 to 35 and connect the nozzles 10 and the pressure chambers 103, respectively.

Further, the protective substrate 102 has two recessed parts 102*a* and two recessed parts 102*b*. Similarly to the recessed parts 23*a* of the protective substrate 23, the two recessed parts 102*a* cover the piezoelectric elements 61. The two recessed parts 102*b* correspond to the two first common channels 105, respectively, are formed in the protective substrate 102 at parts thereof, respectively, which overlap in the up-down direction with the first common channels 105, respectively, and are opened in the lower surface of the protective substrate 102. In this modification, parts each of which is arranged between one of the first common channels 105 and one of the recessed parts 102*b* are dampers 60*a* which are elastically deformable (deformed) to thereby suppress any fluctuation in the pressure of the ink inside the first common channels 105; and the recessed parts 102*b* are damper chambers receiving upward elastic deformation of the dampers 60*a*, respectively. Note that it is allowable that the protective substrate 102 is arranged, in the conveyance direction, on the inner side relative to the two first common channels 105, and that the dampers 60*a* are exposed.

Further, in the above-described examples, it is allowable that the direction in which the ink is fed by the pumps is reversed, and that the ink is circulated between the head unit 11 and the ink tank. Furthermore, the present disclosure is not limited to the configuration wherein the ink is circulated between the head unit and the ink tank. For example, it is allowable that any pomp is not provided between the head unit and the ink tank. In such a case, accompanying with the discharge of the ink from the nozzles 10, the ink inside the first common channels 44 flows from the first throttles 42 into the individual channels 20, respectively, and the ink inside the second common channels 45 flows from the second throttles 43 into the individual channels 20, respectively. Further, in this case, it is possible to prevent any shortage in the refill of the ink to the individual channels 20, more effectively.

Further, although the foregoing explanation has been given about the example wherein the present disclosure is applied to the head unit which discharges the ink from the nozzles, the present disclosure is not limited to this. For example, it is also possible to apply the present disclosure to a liquid discharge head which is configured to discharge a liquid different from the ink, for example, a liquified resin or metal, etc., from the nozzle(s).

What is claimed is:

1. A liquid discharge head comprising a stacked body which is formed by plates stacked in a first direction and which has a liquid channel, wherein the liquid channel includes:

individual channels which include nozzles and pressure chambers communicating with the nozzles, respectively, and which are aligned in a second direction orthogonal to the first direction;

a first common channel extending in the second direction and communicating with the individual channels;

a second common channel extending in the second direction and communicating with the individual channels;

first throttles each of which connects one of the individual channels and the first common channel; and second throttles each of which connects one of the individual channels and the second common channel, the plates include:

a nozzle plate having the nozzles;

a pressure chamber plate having the pressure chambers;

a first common channel plate having the first common channel; and a second common channel plate having the second common channel, the first common channel and the second common channel overlap with each other in the first direction, and the pressure chambers are different from the first and second common channels in positions in a third direction which is orthogonal to the first direction and the second direction, and the pressure chambers do not overlap with the first and second common channels in the first direction.

2. The liquid discharge head according to claim 1, wherein the first common channel is a channel via which liquid is allowed to flow into the individual channels, and the second common channel is a channel via which the liquid is allowed to flow out of the individual channels.

3. The liquid discharge head according to claim 2, wherein the liquid channel is provided with:

individual channel rows which are arranged in the third direction, each of the individual channel rows being formed of the individual channels aligned in the second direction;

first common channels corresponding to the individual channel rows, respectively, and including the first common channel;

second common channels corresponding to the individual channel rows, respectively, and including the second common channel;

a first inflow bypass channel connecting ends on one side in the second direction of the first common channels to each other; and a supply channel which is connected to the first inflow bypass channel and via which the liquid is allowed to flow into the first inflow bypass channel.

4. The liquid discharge head according to claim 3, wherein the liquid channel is further provided with:

a first outflow bypass channel connecting ends on the other side in the second direction of the second common channels to each other; and a discharge channel which is connected to the first outflow bypass channel and via which the liquid is allowed to flow out from the first outflow bypass channel.

5. The liquid discharge head according to claim 4, wherein the liquid channel is further provided with a second inflow bypass channel connecting ends on the other side in the second direction of the first common channels to each other.

6. The liquid discharge head according to claim 4, wherein the flow channel is further provided with:

a second inflow bypass channel connecting ends on the other side in the second direction of the first common channels to each other; and a first connecting channel connecting the first outflow bypass channel and the second inflow bypass channel.

7. The liquid discharge head according to claim 6, wherein the liquid channel is further provided with a second outflow bypass channel connecting ends on the one side in the second direction of the second common channels to each other.

8. The liquid discharge head according to claim 7, wherein the liquid channel is further provided with a second connecting channel connecting the first inflow bypass channel and the second outflow bypass channel.

9. The liquid discharge head according to claim 1, wherein the individual channels have:

the nozzles;

the pressure chambers overlapping with the nozzles, respectively, in the first direction; and descenders extending in the first direction and connecting the nozzles and the pressure chambers, respectively, the second common channel is closer to the nozzle plate than the first common channel in the first direction, each of the first throttles connects the first common channel and one of the pressure chambers, each of the second throttles extends in the third direction and connects the second common channel and one of the descenders, and each of the pressure chambers and one of the second throttles overlap with each other in the first direction.

10. The liquid discharge head according to claim 9, further comprising:

an actuator joined to the stacked body and configured to apply pressure to the liquid inside the pressure chambers; and a protective substrate joined to the stacked body and covering the actuator, wherein the second throttles overlap, in the first direction, with a joining part at which the protective substrate and the stacked body are joined to each other.

11. The liquid discharge head according to claim 10, wherein the first throttles extend in the third direction and overlap, in the first direction, with the joining part at which the protective substrate and the stacked body are joined to each other.

12. The liquid discharge head according to claim 9, wherein the second common channel plate has the second throttles, the nozzle plate overlaps with the second throttles in the first direction, and an end part of the nozzle plate is located at a same position in the third direction as a connecting part at which each of the second throttles and the second common channel are connected to each other.

13. The liquid discharge head according to claim 9, wherein the pressure chamber plate and the first common channel plate are joined to each other.

14. The liquid discharge head according to claim 13, wherein a distance in the third direction between ends, of the pressure chambers, on a side of the first common channel and an end, of the first common channel, on a side of the pressure chambers is not less than 200 μm.

15. The liquid discharge head according to claim 1, further comprising a first damper forming an inner wall surface of the first common channel, wherein the first damper crosses the first direction.

16. The liquid discharge head according to claim 15, further comprising a second damper forming an inner wall surface of the second common channel, wherein the second damper crosses the first direction.

* * * * *